United States Patent [19]

Ginsburg et al.

[11] 3,985,325

[45] Oct. 12, 1976

[54] HOOK HOLDER

[75] Inventors: Stanley D. Ginsburg, Philadelphia, Pa.; Nicholas J. Castoria, Towaco, N.J.

[73] Assignee: Diversified Marketing Group, Inc., Bellmawr, N.J.

[22] Filed: July 28, 1975

[21] Appl. No.: 599,683

[52] U.S. Cl. ..... 248/223; 248/475 A; 248/304; 248/DIG. 3

[51] Int. Cl.[2] ..... A47F 5/00; F16B 45/00

[58] Field of Search ..... 211/57, 59, 96, 102, 211/105.1, 105.2; 248/44, 217–219, 223, 227, 302–304, 310, 289, 290, 475 A, DIG. 3, DIG. 9, 45; 403/3

[56] References Cited

UNITED STATES PATENTS

| | | | |
|---|---|---|---|
| 991,517 | 5/1911 | Kennedy | 403/3 X |
| 2,842,264 | 7/1958 | Larson | 248/DIG. 3 |
| 3,198,469 | 8/1965 | Callanan | 248/DIG. 3 |
| 3,409,260 | 11/1968 | Bleed | 248/216 |
| 3,452,954 | 7/1969 | Lucietto et al. | 248/223 X |
| 3,473,756 | 10/1969 | Jones | 211/59 X |
| 3,738,601 | 6/1973 | Gehringer | 248/210 |
| 3,897,926 | 8/1975 | Silver | 248/223 |

*Primary Examiner*—Lawrence J. Staab

[57] ABSTRACT

A plastic holder for an L-shaped hook has a vertical bore and a horizontal groove arranged to hold hooks of two different diameters, such as 3/16 inch and ¼ inch diameter. A pair of breakaway ears helps to hold the larger hook in place, and the hook will rotate harmlessly about the shorter leg when the hook is struck by a person.

7 Claims, 6 Drawing Figures

FIG. 1
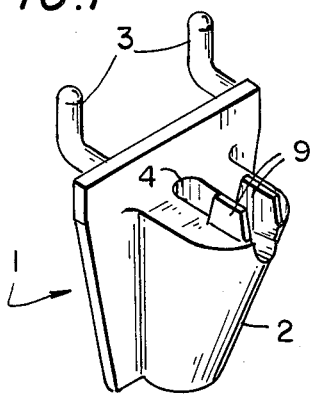
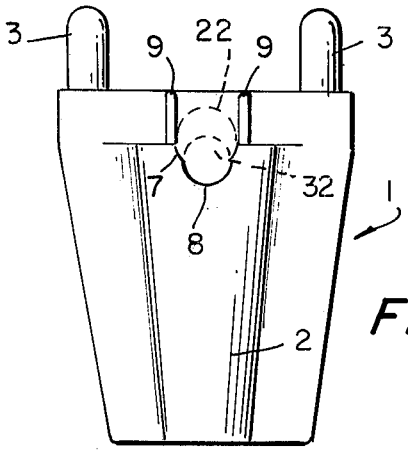
FIG. 2
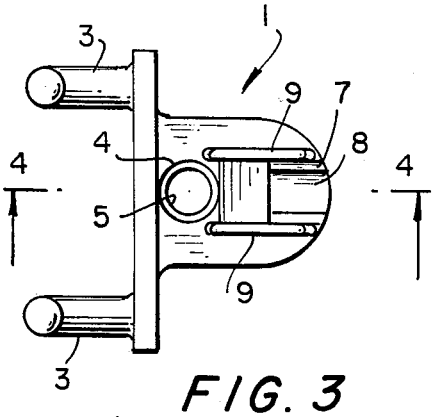
FIG. 3
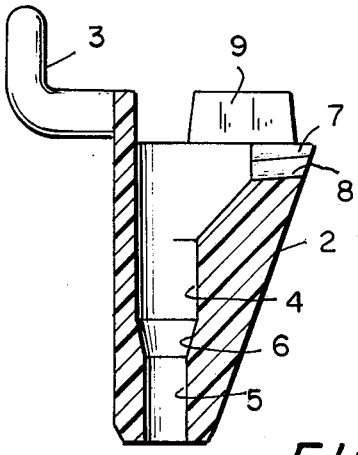
FIG. 4
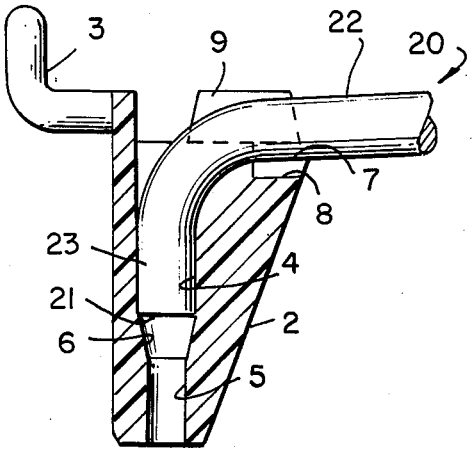
FIG. 5
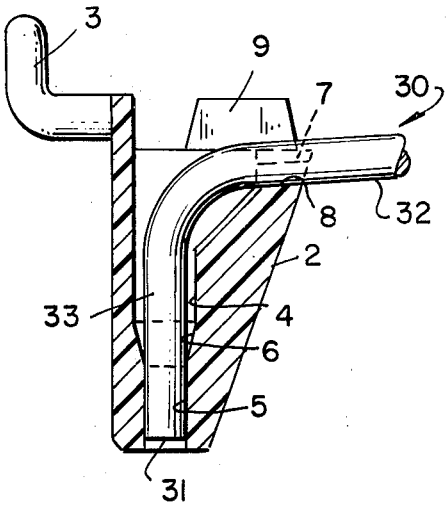
FIG. 6

HOOK HOLDER

The present invention relates to a holder for hooks used in display systems and the like.

In display systems for displaying merchandise, a perforated board is used to hold several plastic hook-holders, which in turn hold an L-shaped hook from which the merchandise is hung. The hook-holders commonly have a pair of 90° lugs that fit into the perforated board and thus mount the holder to the board. The L-shaped hook has a short leg that fits into a vertical bore in the holder and a longer leg that rests in a horizontal groove in the holder. The L-shaped hooks come in two popular sizes, 3/16 inch diameter and ¼ inch diameter, but the holders can accommodate either one or the other size, not both, thus requiring a double inventory of holders.

Further, the ¼ inch hooks are 9 inches to 12 inches long, whereas the 3/16 inch hooks are only 6 inches long, and often the ¼ inch hooks are struck by a customer walking past the display. Up till now, the holders have not dealt with this safety problem.

It is thus an object of the invention to provide a holder that can hold two different sized hooks.

It is another object of the invention to provide a holder that will minimize injuries caused by a person striking a long hook.

These and other objects of the invention are fulfilled by the present invention, which provides a holder for an L-shaped hook having a short leg and a longer leg, which comprises a body, a vertical circular bore through said body, the upper portion of said vertical bore having a larger diameter than the lower portion of said vertical bore, a horizontal groove in the upper face of said body extending longitudinally from one edge of said upper face to and into said bore, said horizontal groove and said vertical bore being substantially perpendicular to each other, said horizontal groove having a lower arcuate portion that is a segment of a circle and an upper arcuate portion formed by a pair of opposed, diverging arcuate walls, said vertical bore and said horizontal groove being so arranged with respect to one another that 1) an L-shaped hook of a larger diameter will fit into said holder with the short leg of the L in the upper portion but not the lower portion of the vertical bore, and the longer leg of the L resting on and supported by the diverging arcuate walls, and 2) an L-shaped hook of a smaller diameter will fit into said holder with the short leg of the L extending through said upper portion of said vertical bore and into said lower portion of the vertical bore and the longer leg of the L resting in and supported by the lower arcuate portion of the horizontal groove.

The holder of the present invention may also include a pair of opposed ears rising from the upper face of the body, one ear being on either side of the groove, the upper portion of the groove being arranged to support the larger diameter hook with a substantial portion of the longer leg above the upper face of the body, said ears being operable to break away from said body when struck by said longer leg as the hook rotates in said holder about the short leg.

The present invention is illustrated by the accompanying drawing, in which:

FIG. 1 is a perspective view of the holder of the invention;

FIG. 2 is a front elevational view of the holder of the invention;

FIG. 3 is a top plan view of the holder of the invention;

FIG. 4 is a view, in section, along lines 4—4 of FIG. 3; and

FIGS. 5 and 6 are views similar to FIG. 4 showing two different size hooks being held by the holder.

With reference to the drawing, the holder 1 has a main body 2 from which extends a pair of hooks 3, which are sized to fit into a pair of holes in a perforated board. Within the body 2 are the large vertical bore 4, the smaller vertical bore 5, and the converging wall 6 therebetween. Horizontally disposed within body 2 is the lower arcuate channel 8 and the upper arcuate walls 7. Rising from body 2 is a pair of rigid ears 9.

Body 2, hooks 3 and ears 9 are readily formed as a onepiece molding from any desired thermoplastic or thermosetting plastics material, such as a polyolefin, polyamide, polyacrylic, polycarbonate, and the like. Bores 4 and 5 are formed by simple drilling operations, thus forming wall 6 as well. Similarly, the horizontal channel 8 and arcuate wall 7 are formed by drilling a large horizontal bore and a lower, smaller horizontal bore. Preferably, the entire holder 1 with the bores 4 and 5, channel 8, arcuate wall 7 and ears 9 can be formed in a single molding operation.

The holder 1 is adapted to hold hooks of two different sizes, such as hooks 20 and 30 (FIGS. 5 and 6). For example, hooks of ¼ inch and 3/16 inch are commonly employed, and to accommodate such hooks, bore 4 will be slightly larger than ¼ inch, say 0.255 inch, and bore 5 will be slightly larger than 3/16 inch, say 0.188 inch. To aid in insertion and removal of the hooks, bores 4 and 5 will taper inwardly from the top to the bottom of the bores, say from 0.261 to 0.255 inch for bore 4, and from 0.194 to 0.188 inch for bore 5. Channel 8 will be an arc of a circle of slightly larger than 3/16 inch diameter, such as 0.094 inch radius, and arcuate walls 7 will be arcs of a circle of slightly larger than ¼ inch diameter, such as 0.135 radius.

The ¼inch hook 20 will fit into the holder 1 as shown in FIG. 5, with the bottom 21 of the hook 20 at the bottom of bore 4 and the arm 22 resting on the arcuate walls 7. The dotted line in FIG. 1 shows the position of the arm 22 in the holder. The 3/16 inch hook 30 will fit into the holder 1 as shown in FIG. 6 with the bottom 31 of hook 30 at the bottom of bore 5 and the arm 32 resting in channel 8. The dot-dash line in FIG. 1 shows the position of the arm 32 in the holder.

As seen in FIGS 2 and 5, the arm 22 of the large hook 20 comes well above the middle of the ears 9. Hooks of ¼ inch diameter are usually 9 inches or 12 inches long, and these long hooks are often struck by a person and hence are a potential source of injuries. To prevent such injuries, ears 9 are made sufficiently thin so that when the holder is made of brittle material, such as polyacrylics or polycarbonates, an ear 9 can break off when the arm 22 is hit by a person. By making bore 4 slightly oversized, the hook 20 can swivel in the bore 4 when arm 22 is hit, to facilitate the breaking off of an ear 9.

If desired, ears 9 can be glued or otherwise detachably secured to body 2 instead of being molded in one piece with body 2. Further, ears 9 can be scored (not shown) near where they join body 2 to aid in rapid breaking.

It is noted that channel 8 and arcuate walls 7 incline slightly to the horizontal. Hooks 20 and 30 are formed with an angle of slightly more than 90° between the arms 22 and 32 and the short legs 23 and 33, respectively, such as 93°–96°. Hooks 20 and 30 will thus be more likely to retain the right angle shape in this manner, since the slightly obtuse angle between the arms 22 and 32 and legs 23 and 33, respectively, acts to prestress the hooks against bending too far down and the inclined channel 8 and walls 7 act to maintain this obtuse angle.

What is claimed is:

1. A holder for an L-shaped hook having a short leg and a longer leg, which comprises a body, a vertical circular bore through said body, the upper portion of said vertical bore having a larger diameter than the lower portion of said vertical bore, a horizontal groove in the upper face of said body extending longitudinally from one edge of said upper face to and into said bore, said horizontal groove and said vertical bore being substantially perpendicular to each other, said horizontal groove having a lower arcuate portion that is a segment of a first circle and an upper arcuate portion formed by a pair of opposed, diverging arcuate walls that are segments of a second circle, said vertical bore and said horizontal groove being so arranged with respect to one another that (1) an L-shaped hook of a larger diameter will fit into said holder with the short leg of the L in the upper portion, but not the lower portion, of the vertical bore and the longer leg of the L resting on and supported by the diverging arcuate walls, and (2) an L-shaped hook of a smaller diameter will fit into said holder with the short leg of the L extending through said upper portion of said vertical bore and into said lower portion of the vertical bore and the longer leg of the L resting in and supported by the lower arcuate portion of the horizontal groove.

2. The holder according to claim 1, wherein the axis of the horizontal groove extends up and away from the vertical bore at an angle of slightly more than 90°, whereby the upper and lower portions of the groove are adapted to support the longer leg of an L-shaped hook that has an angle between the legs thereof of slightly more than 90°.

3. The holder according to claim 1, wherein there is a pair of opposed ears rising from the upper face of the body, one ear being on either side of the groove, the upper portion of the groove being arranged to support the larger diameter hook with a substantial portion of the longer leg above the upper face of the body, said ears being operable to break away from said body when struck by said longer leg as the hook rotates in said holder about the short leg.

4. The holder according to claim 3, wherein said ears are of a thickness such that they will break away from the body when struck.

5. The holder according to claim 4, wherein the upper and lower portions of said vertical bore and the upper and lower arcuate sections of the horizontal groove are of a size to hold both a 3/16 inch and a ¼ inch L-shaped hook.

6. The holder according to claim 1, wherein the upper and lower portions of the vertical bore each taper inwardly from the top of each portion to the bottom thereof.

7. The holder according to claim 1, wherein said body includes means for supporting the holder on a perforated board.

* * * * *